United States Patent [19]

Spiller

[11] Patent Number: 4,816,801

[45] Date of Patent: Mar. 28, 1989

[54] VARIABLE RESISTOR

[75] Inventor: Gerhard Spiller, Saal a. d. Saale, Fed. Rep. of Germany

[73] Assignee: Preh, Elektrofeinmechanische Werke, Jakob Preh, Nachf. GmbH & Co., Bad Neustadt/Saale, Fed. Rep. of Germany

[21] Appl. No.: 95,428

[22] Filed: Sep. 11, 1987

[30] Foreign Application Priority Data

Sep. 12, 1986 [DE] Fed. Rep. of Germany ..... 3631056

[51] Int. Cl.[4] ..... H01C 10/32

[52] U.S. Cl. ..... 338/163; 338/184; 338/199

[58] Field of Search ..... 338/160, 162, 163, 164, 338/184, 199

[56] References Cited

U.S. PATENT DOCUMENTS

| | | | |
|---|---|---|---|
| 2,329,949 | 9/1943 | Shapiro | 338/163 |
| 2,884,506 | 4/1959 | Graustein et al. | 338/175 |
| 2,901,720 | 8/1959 | Kerslake | 338/163 |
| 4,430,634 | 2/1984 | Hufford et al. | 338/164 |

FOREIGN PATENT DOCUMENTS

| | | |
|---|---|---|
| J10118 | 3/1956 | Fed. Rep. of Germany . |
| 1490258 | 11/1968 | Fed. Rep. of Germany . |
| 1490454 | 9/1969 | Fed. Rep. of Germany . |
| 7815934 | 5/1978 | Fed. Rep. of Germany . |
| 0157666 | 10/1985 | France . |

OTHER PUBLICATIONS

Abstract of Patent Appln. No. 310,399 (May 18, 1960).

*Primary Examiner*—C. L. Albritton
*Attorney, Agent, or Firm*—Wegner & Bretschneider

[57] ABSTRACT

It should be possible to adjust without difficulty the moment of friction occurring during rotation on a variable resistor. A bolt (11) is provided for this purpose for holding a rotating part (13) axially in position with a base component (2). A tap (24) is brought into contact with a resistance track (5) rotating in the base component (2) in a radial direction to the axis of rotation (14). The bolt (11) can at the same time be used for securing the variable resistor (1) and as the electrical connection for the tap (24).

10 Claims, 2 Drawing Sheets

II 18
5
17
1
20
4
3
23
2
15
10
12
11,14
16
19
27
9
8
13
28
21,22
7
II

VARIABLE RESISTOR

The invention relates to a variable resistor, on which a rotating part is rotatably mounted on a base component bearing a resistance track, which is held axially in position with the base component for creating a friction moment during rotation and to which a tap located on the resistance track is secured.

A variable resistor of the above type is described in German utility model DE-GM No. 78 15 934. This variable resistor is of a very small size in view of its typical application as a volume control in hearing aids.

On a variable resistor of this type the rotating part is held in position with the base component axially by means of reveting or flanging. The friction moment resulting from this during the rotation of the rotating part cannot be adjusted within narrow limits but is more or less arbitrary. On the known variable resistor, the resistance track consists of a circular ring-shaped surface in the base component which extends radially to the axis of rotation, whilst the sprung tap is held pressed on the resistance track by means of riveting or flanging. The holding in position axially of the rotating part with the base component and the contact pressure force of the tap are therefore bound together in a non-detachable arrangement so that an increase in the axial tension is associated with a corresponding increase with the contact pressure force of the tap; the same applies in the reverse case. The result of this is that the friction moment occurring during the rotation of the rotating part cannot be increased without the contact pressure force of the tap on the resistance track also being increased.

On the known variable resistor a threaded pin is attached to the base component which can be used to attach the variable resistor to a base plate. The threaded pin may also be used as an electrical connection.

On a similar known variable resistor the rotating part is held in position axially in relation to the base component with a pin and a spring ring. Here again the friction moment obtained depends on various uncertain factors so that it can hardly be determined exactly.

A rotary potentiometer with a return spring is described in U.S. Pat. No. 4,430,634. Here however it is not a question of a particular capacity for setting the friction moment. A similar rotary potentiometer is known from EP-No. 0 157 666.

The object of the invention is to propose a variable resistor of the type mentioned in the introduction, on which a friction moment produced during the rotation of the rotating part can be set and adjusted in a simple manner even if the variable resistor is of small size.

The above object is achieved according to the invention on a variable resistor of the type described in the introduction, in that a bolt which is coaxial with the axis of rotation is provided for holding the rotating part in position axially, whereby the shank of this bolt is screwed to the base component and its head presses onto the rotating part. The force with which the rotating part is pressed onto the base component can be set by tightening the bolt to a greater or lesser degree and by these means the friction moment occurring with the rotation of the base component can be set accurately. It is also an advantage that if an excessive friction moment is set initially it can be reduced by releasing the bolt slightly.

In a preferred embodiment of the invention the resistance track extends coaxially about the axis of rotation and the tap presses onto the resistance track in the radial direction to the axis of rotation. The contact pressure force of the tap acts therefore at right angles to the force with which the rotating part is pressed onto the base component and in this way the forces are independent of each other. It is possible therefore to achieve a high friction moment without the contact pressure force of the tap on the resistance track being correspondingly high.

Other advantageous embodiments of the invention are given by the subordinate claims in the following description of an example of an embodiment.

The drawings show the following:

Figure 1:
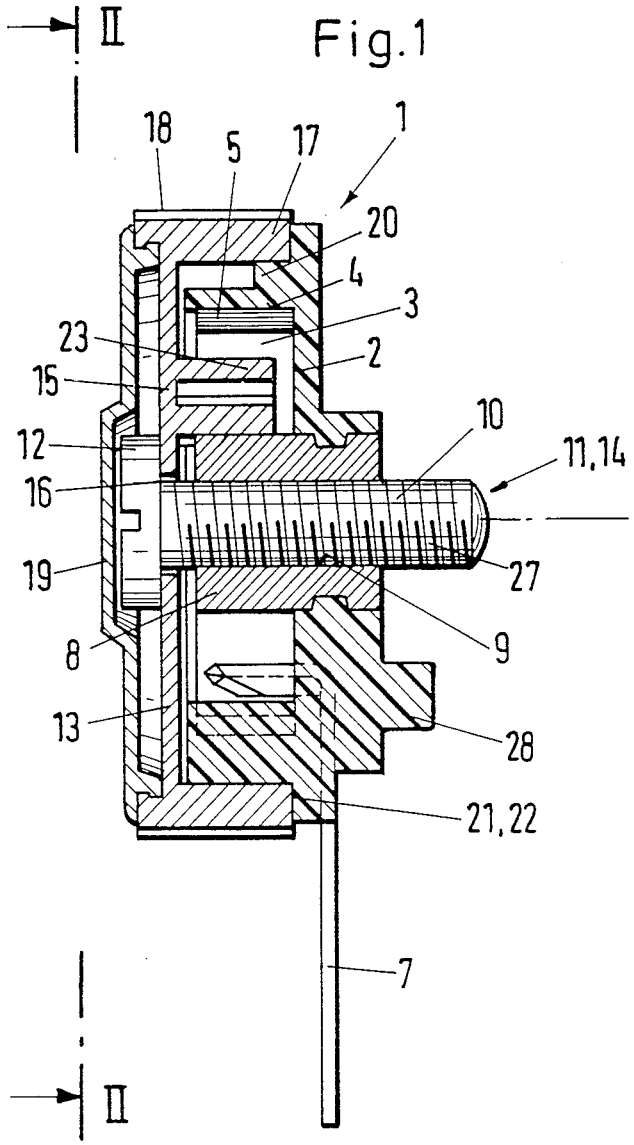
FIG. 1 shows a sectional view of a variable resistor.
Figure 2:
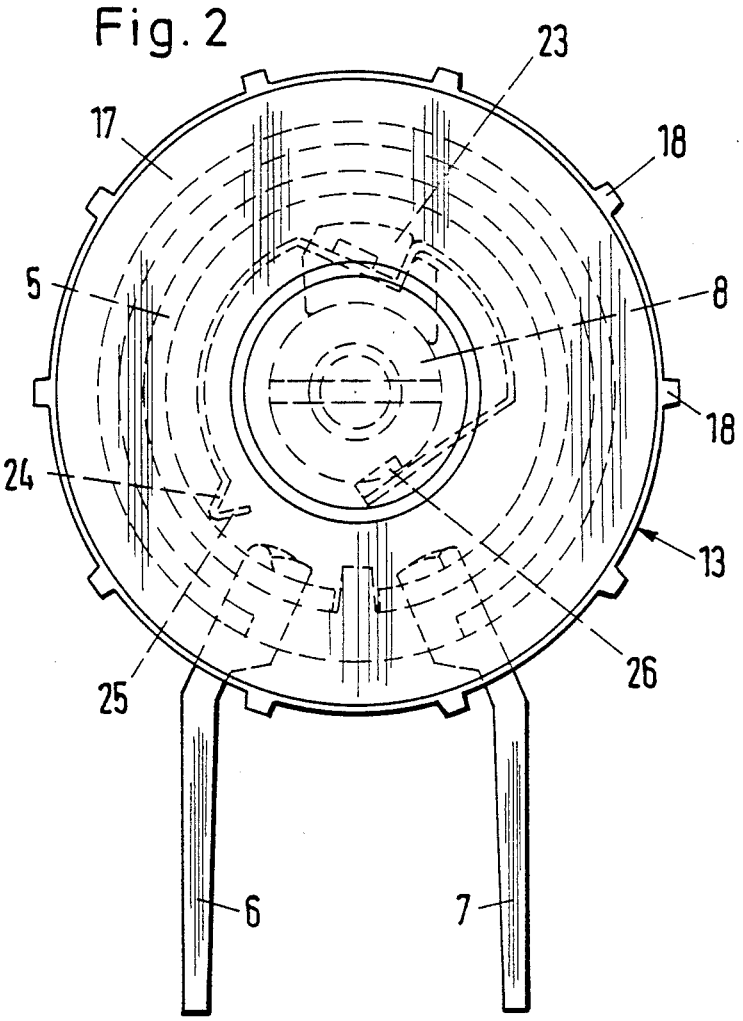
FIG. 2 shows a plan view of the variable resistor along the line II—II according to FIG. 1

A variable resistor (1) has a plastic base component (2), in which is formed a cylindrical inner space (3). A resistance track (5) rotates on the inside at the cylindrical wall (4) of the inner space (3), whereby both its ends are connected with connection pins (6, 7) around which the base component (2) is injection molded.

A metal sleeve (8) is secured to the base component (2) so that it is concentric with the wall (4) and it can be secured to the base component (2) in such a way that when it is formed the plastic material of which it is made is injection molded around the sleeve (8). The sleeve (8) is fitted with an internal thread (9) into which the shank (10) of a bolt (11) is screwed, the head of which is designated (12).

A rotating part (13) is fitted to the base component (2) about an axis of rotation (14) which coincides with the axis of the bolt (11). The rotating part (13) is provided with a base (15) with a hole (16) for the bolt (11) and a ring edge (17), whilst several protrusions (18) for operating the rotating part (13) are formed on the outside at the ring edge (17). A cap (19) covering the bolthead (12) is snapped on to the rotating part (13). The ring edge (17) engages over the wall (4) and is run radially to the axis of rotation (14) from a stage (20) which rotates at this. The front face (21) of the ring edge (17) abuts at a ring surface (22) of the base component (2).

A holder (23) for a tap (24) is formed on the base (15). One end (25) of the tap (24) abuts at the resistance track (5) in a radially sprung arrangement, whilst the other end (26) of the tap (24) also abuts the sleeve (8) in a radially sprung arrangement.

The desired friction moment with the rotation of the rotating part (13) is set as follows:

After the rotating part (13) has been placed on the base component (2), the bolt (11) is screwed into the sleeve (8) until its head (12) presses onto the base (15). The bolt (11) is then tightened to the extent that the front face (21) of the ring edge (17) is pressed sufficiently hard onto the ring surface (22) of the base component (2) as is necessary for the desired operating torque for the rotation of the rotating part (13). The contact pressure force of the ends (25, 26) of the tap (24) on the resistance track (5) or the sleeve (8) is not altered during this operation.

After it has been set correctly the bolt can be fixed in the sleeve (8) after which the cap (19) is snapped on.

Figure 3:
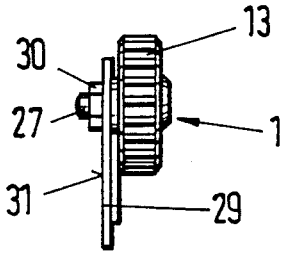
FIG. 3 shows a unit on a reduced scale in relation to FIG. 2.

A section (27) of the shank (10) of the bolt (11) protrudes beyond the base component (2) (see FIGS. 1 and 3), whilst a protrusion (28) is formed on the base component (2) next to the section (27) to prevent rotation.

To form the variable resistor (1) into a structural component (See FIG. 3) the resistor (1) with the section (27) and the protrusion (28) are inserted in a corresponding recess of a base plate (29). The section (27) protrudes beyond the base plate (29) so that the variable resistor (1) can be fixed to the base plate (29) by means of a nut (30) screwed on to the section (27). An electrical conducting surface (31) or another electrical connection is provided on the base plate (29) in the area of the nut (30). In this way an electrical connection is established with the tap (24) by means of the nut (30) via the bolt (11), the metal sleeve (8) and the end (26).

The bolt (11) performs several different functions. It holds the rotating part (13) at the base component (2) and ensures that the required contact pressure force is provided between the front face (21) and the ring surface (22). It is used to secure the variable resistor (1) to the base plate (29) mechanically and it forms the electrical connection of the tap (24).

| Reference List 11/86 Pt. + GM | |
|---|---|
| 1 | Variable resistor |
| 2 | Base component |
| 3 | Inner space |
| 4 | Cylinder wall |
| 5 | Resistance track |
| 6 | Connection pin |
| 7 | Connection pin |
| 8 | Sleeve |
| 9 | Internal thread |
| 10 | Shank |
| 11 | Bolt |
| 12 | Bolthead |
| 13 | Rotating part |
| 14 | Axis of rotation |
| 15 | Base |
| 16 | Hole |
| 17 | Ring edge |
| 18 | Protusion |
| 19 | Cap |
| 20 | Stage |
| 21 | Front face |
| 22 | Ring Surface |
| 23 | Holder |
| 24 | Tap |
| 25 | End |
| 26 | End |
| 27 | Section |
| 28 | Protrusion |
| 29 | Base plate |
| 30 | Nut |
| 31 | Conducting surface |

What is claimed is:

1. A variable resistor, comprising:

a base component bearing a resistance track;

a rotating part mounted to said base component, said rotating part being held in position axially so as to create a friction moment when said rotating part is rotated with respect to the base component about an axis of rotation;

a tap secured to said rotating part and pressed against said resistance track; and a bolt having an axis which is coaxial with the axis of rotation, said bolt having a shank which is screwed to the base component and a head which presses on the rotating part;

wherein said rotating part has a ring edge which presses against the base component along a ring surface located around an outer peripheral edge of the base component, the friction moment being created essentially only by the ring edge pressing against the ring surface.

2. A variable resistor as claimed in claim 1, wherein said resistance track is essentially circular and has an axis parallel to the axis of rotation, and wherein said tap presses against the resistance track in a radial direction with respect to the axis of rotation.

3. A variable resistor as claimed in claim 1, further comprising a sleeve fixed to said base component, wherein the shank of said bolt is screwed into said sleeve.

4. A variable resistor, comprising:

a base component bearing a resistance track;

a rotating part mounted to said base component, said rotating part being held in position axially so as to create a friction moment when said rotating part is rotated with respect to the base component about an axis of rotation;

an electrically-conductive sleeve fixed to said base component;

a tap secured to said rotating part, a first portion of said tap being pressed against said resistance track, a second portion of said tap contacting said electrically-conducting sleeve;

a bolt having an axis which is coaxial with the axis of rotation, said bolt having a shank which is screwed to the sleeve and a head which presses on the rotating part;

wherein said rotating part has a ring edge which presses against the base component along a ring surface located around an outer peripheral edge of the base component, and wherein said sleeve serves as an electrical terminal post.

5. A variable resistor as claimed in claim 4, wherein the second portion of said tap presses into the sleeve in a radial direction with respect to the axis of rotation.

6. A variable resistor as claimed in claim 1, further comprising a base plate, wherein a portion of the shank of the bolt protrudes beyond the base component, said portion of the shank being secured to the base plate.

7. A variable resistor as claimed in claim 6, wherein said bolt is electrically conductive, and further comprising an electrical conductor which is in contact with said portion of the shank of the bolt.

8. A variable resistor as claimed in claim 3, wherein said base component is made of plastic and is injection molded around said sleeve.

9. A variable resistor as claimed in claim 1, wherein the ring edge of the rotating part extends essentially parallel to the axis of rotation and wherein said ring surface comprises a circumferential step located around the outer peripheral edge of the base component which the ring edge engages.

10. A variable resistor as claimed in claim 4, wherein the shank of said bolt extends through said sleeve, and also serves as an electrical terminal post.

* * * * *